US005386927A

United States Patent [19]

Janssen

[11] Patent Number: 5,386,927

[45] Date of Patent: Feb. 7, 1995

[54] APPARATUS AND METHOD FOR SYRUP FLOW LINE CLEARING

[76] Inventor: Adolf Janssen, 150-59 Hoover Ave., Jamaica, N.Y. 11432

[21] Appl. No.: 199,490

[22] Filed: Feb. 22, 1994

[51] Int. Cl.[6] ..... B67D 1/08

[52] U.S. Cl. ..... 222/1; 137/240; 222/66; 222/148

[58] Field of Search ..... 222/1, 52, 63, 64, 61, 222/66, 67, 129.1–129.4, 145, 148; 137/15, 209, 238, 240, 241; 134/22.11, 22.12, 22.15, 22.18

[56] References Cited

U.S. PATENT DOCUMENTS

| | | | |
|---|---|---|---|
| 2,619,119 | 11/1952 | Warcup | 137/240 X |
| 3,373,762 | 3/1968 | Korchak | 137/240 |
| 3,898,861 | 8/1975 | McMillin | 137/238 X |
| 3,945,536 | 3/1976 | Doak | 222/66 X |
| 4,467,941 | 8/1984 | Du | 222/66 X |
| 4,632,275 | 12/1986 | Parks | 222/66 X |
| 4,795,061 | 1/1989 | Peckjian | 222/66 |
| 4,886,190 | 12/1989 | Kirschner et al. | 222/148 X |
| 5,072,859 | 12/1991 | Wiley | 222/148 |
| 5,174,323 | 12/1992 | Haselden | 137/240 X |

FOREIGN PATENT DOCUMENTS

| | | | |
|---|---|---|---|
| 2202693 | 8/1990 | Japan | 222/66 |

*Primary Examiner*—Kevin P. Shaver
*Attorney, Agent, or Firm*—Michael I. Kroll

[57] ABSTRACT

An apparatus and method to eliminate the waste involved in flushing out the syrup in the delivery line between the dispensing tank and the mixing chamber in a large-scale bottling operation. The apparatus consists of a pair of sensors or probes. The first is located between the dispensing tank and the pump and is connected to a microprocessor that controls the subsequent actions of the device. Also connected to the delivery line downstream of the pump are an air supply, a water supply, and a supply of pressurized $CO_2$. These are also connected to the processing unit. When the first probe detects air in the line upstream of the pump, it notifies the processor, which shuts off the pump, and opens up the $CO_2$ supply line. This then drives the syrup that is present in the delivery line towards the mixing chamber. Thus the mixing and bottling process continues normally. A second probe located upstream from and proximate to the mixing chamber notifies the microprocessor upon detection of gas in the line at its location, thus stopping the mixing operation and allowing the delivery line to be flushed as before with a minimum of syrup waste.

6 Claims, 2 Drawing Sheets

APPARATUS AND METHOD FOR SYRUP FLOW LINE CLEARING

BACKGROUND OF THE INVENTION

1. Field of the Invention

The present invention relates to beverage mixing operations. More specifically, it relates to an apparatus and method for detecting when the syrup being dispensed toward a mixing chamber is depleted and then implementing a line clearing device for driving the syrup present in the line between the dispensing tank and the mixing tank into the mixing tank to alleviate the waste of the syrup in the line. Even more specifically, it relates to an apparatus and method wherein a pair of operating probes or sensors is present in the line, with the first probe being proximate to the dispensing tank and the second being proximate to the mixing chamber. Upon detection of air in the line by the first probe, the line pump is deactivated and a compressed gas is inserted into the line to drive the syrup contained therein towards the mixing chamber. When the second probe detects the presence of the gas in the line at its location, the compressed gas flow is halted, to allow for the refilling of the main dispensing tank and the subsequent flavor change and continuation of the bottling process.

More generally the inventive concept could be used in any pipeline operation where it is desired to change the type of fluid in a line from time to time without interruption of the flow to flush the line.. One such application would be in cross-country petroleum pipelines such as for blowing out all the diesel fuel from the line before beginning to pump a higher or lower distillate, Thus it can be seen that the potential fields of use for this invention are myriad and the particular preferred embodiment described herein is in no way meant to limit the use of the invention to the particular field chosen for exposition of the details of the invention, A comprehensive listing of all the possible fields to which this invention may be applied is limited only by the imagination and is therefore not attempted here. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

In the soft drink industry, during the bottling process, the syrup to be mixed with the water and $CO_2$ is contained within a large tank, generally holding about 4000 gallons. This syrup is pumped through a line towards a mixing chamber, and then, after the mixing process, into the various cans, bottles, and the like used for marketing the finished product. When the dispensing tank is empty, the pump shuts down and the line between the dispensing and the mixing tank is flushed, and the syrup contained therein is dumped. In a conventional bottling plant the line between the dispensing and mixing tank is stainless steel tubing, about a two inches in diameter, and the length of the line is about 100 feet. This constitutes a waste of about 50 gallons of the syrup at every flavor change at the plant, these flavor changes generally occurring about four to six times a day. Applicant's present invention is addressed to this problem, allowing the utilization of the syrup in the line. Following hereinafter is a discussion of patents that bear on the dispensing and mixing of carbonated beverages.

Firstly, U.S. Pat. No. 3,945,536 issued on Mar. 23, 1976 to Gerald Doak discloses a sanitizing and cleaning device for pressurized soft drink systems. The device is attached to the existing lines between the tap heads and the $CO_2$ tank and is filled with water and a sanitizing solution. When the tap heads are opened, the sanitizing solution is driven into the lines by the gas pressure until all of the solution is gone. A float then switches the pressure of the water in the device, which is then driven through the lines to flush them. This is in contrast to the present invention, which uses $CO_2$ to drive the syrup in the lines towards the mixing chamber and includes a pair of sensors to monitor the presence and absence of the syrup that is being impelled.

Next is U.S. Pat. No. 4,467,941 issued on Aug. 28, 1984 to Benjamin R. Du. This discloses an apparatus and method for dispensing beverage syrup wherein air trap/filters are disposed in the line between the bag/box syrup containers and a low flow rate, positive displacement pump. Upon the detection of the presence of air in the dispensing line, the pump can be shut down or, additionally, a diverter valve can be activated to allow for a continuous flow while the empty container is replaced. Contrast this to applicant's invention wherein, upon detection of air downstream of the dispensing tank, the pump is not only shut down, but additionally a flow of pressurized gas is introduced into the line to substantially empty it of any remaining syrup further downstream of the pump.

In U.S. Pat. No. 4,632,275 issued on Dec. 30, 1986 to Charles K. Parks there is disclosed a palatability stabilizer that monitors the $CO_2$ pressure in a postmix fountain drink dispensing system. The sensor is connected to a switch that disconnects power to the dispenser when the pressure falls below a predetermined level. This is unlike applicant's present invention in that the power to the fountain dispenser is shut off upon the switch or relay activation, and that the document does not teach introducing pressurized gas into the line for any reason.

Lastly, U.S. Pat. No. 5,072,859 issued on Dec. 17, 1991 to Ronald L. Wiley et al. discloses a beverage dispensing system with a purging feature. The purging feature functions as a result of a timer or thermometer, so as to prevent the warm soda water in the line from being dispensed, and it also functions when a light colored drink is dispensed after a dark colored drink to prevent inadvertent mixing of flavors. Contrast this to applicant's invention wherein $CO_2$ is introduced under pressure to clear the line of syrup before the mixing chamber.

None of the above inventions and patents, taken either singly or in combination, is seen to describe the instant invention as claimed.

SUMMARY OF THE INVENTION

This invention is an improved beverage bottling mixing apparatus utilizing flavored syrups comprising:

(1) a dispensing tank for the holding of a quantity of flavored syrups;

(2) a mixing chamber for the mixing of predetermined ratios of the syrups and carbonated water;

(3) piping means extending from said dispensing tank to said mixing chamber;

(4) a pump located on said piping means such that the activated pump produces a downstream and upstream flow in said piping means, and further delineates a first portion of pipe disposed between said dispensing tank and said pump and a second portion of pipe disposed between said pump and said mixing chamber;

(5) gas inlet means disposed on said second portion of said piping means;

(6) processing means for control of said pump, said gas inlet means, and said mixing chamber;

(7) a first sensor means located on said first portion of pipe, said sensor being connected to said processing means such that when said first sensor detects an absence of syrup in said first portion of said piping means, said processing means deactivates said pump and opens said gas inlet means into said second portion of said piping means, thus impelling any syrup remaining in said second portion of said piping means downstream towards said mixing chamber; and (8) a second sensor means located in said second portion of said piping means, said second sensor being in connection with said processing means such that when said second sensor detects an absence of syrup in said second portion of said piping means, said processing means deactivates the beverage mixing process.

The present invention is an apparatus and also a method to eliminate the waste involved in flushing out the syrup in the delivery line between the dispensing tank and the mixing chamber in a large-scale bottling operation. The apparatus consists of a pair of sensors or probes. The first is located between the dispensing tank and the pump and is connected to a microprocessor that controls the subsequent actions of the device. Also connected to the delivery line downstream of the pump are an air supply, a water supply, and a supply of pressurized $CO_2$. These are also connected to the processing unit. When the first probe detects air in the line upstream of the pump, it notifies the processor, which shuts off the pump, and opens up the $CO_2$ supply line. This then drives the syrup that is present in the delivery line towards the mixing chamber. Thus the mixing and bottling process continues normally. A second probe located upstream from and proximate to the mixing chamber notifies the microprocessor upon detection of gas in the line at its location, thus stopping the mixing operation and allowing the delivery line to be flushed as before with a minimum of syrup waste.

Accordingly, it is a principal object of the invention to provide an apparatus and method that alleviates the waste inherent in flushing and dumping the syrup delivery line in a large-scale soft drink bottling operation.

It is another object of the invention to use a first probe sensitive to the presence of air in the line between the dispensing tank and the pump to initiate the gas discharge into the delivery line that impels the remaining syrup in the line towards the mixing chamber.

It is a further object of the invention to use a second probe sensitive to the presence of a gas in the delivery line upstream of and proximate to the mixing chamber to halt the mixing process.

Still another object of the invention is to provide for the entire process to be automatically controlled by a microprocessor.

It is a goal of the invention to provide improved elements and arrangements thereof in an apparatus for the purposes described which is inexpensive, dependable and fully effective in accomplishing its intended purposes.

It is submitted that the present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
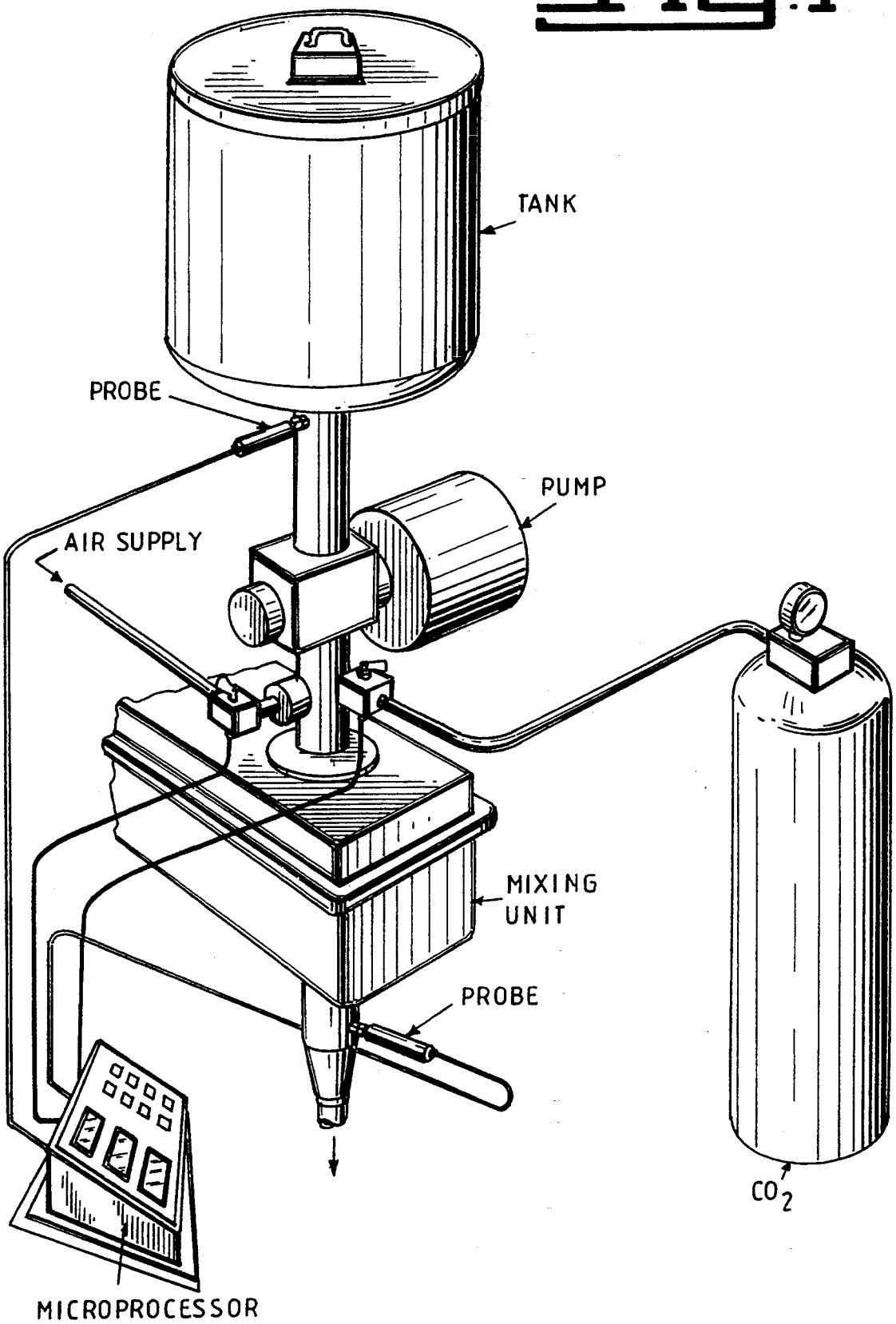
FIG. 1 is a perspective view of the present invention showing the general appearance of the major components.
Figure 2:
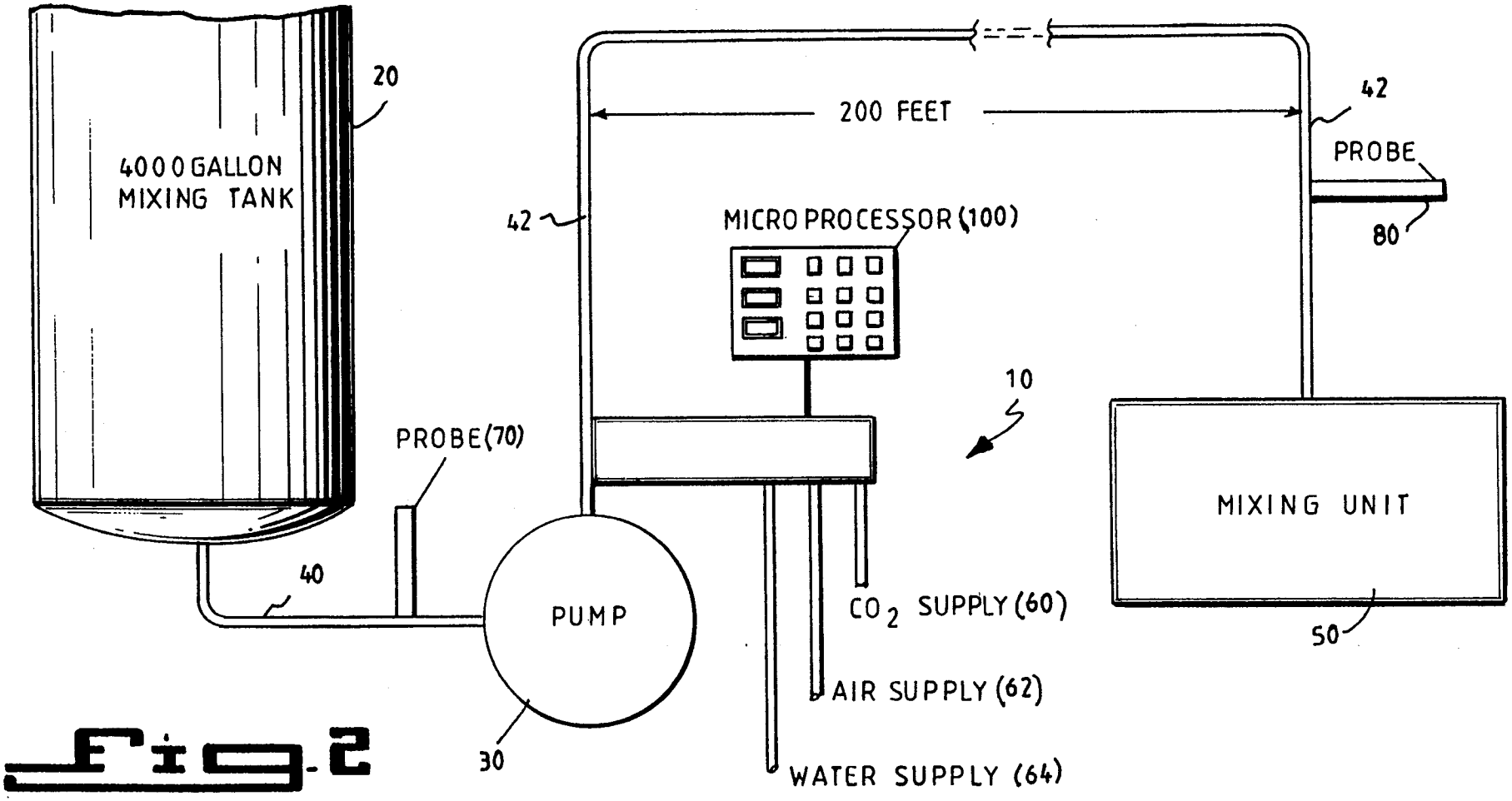
FIG. 2 is a schematic view of the present invention illustrating the interconnection of the major components.

In FIG. 2 a mixing operation for a soft drink bottling operation is schematically shown and indicated generally at 10. In conventional mixing operations, the flavored syrup is held in a dispensing tank 20. A pump 30 draws the syrup into a first section of pipe 40, and then impels the syrup through a second section of pipe 42. This section of pipe 42 is, in most conventional bottling plants, between 100 and 200 feet long. Both first section 40 and second section 42 of the pipe are generally made of stainless steel and have a diameter of about two inches. The dispensing tank 20 holds in the neighborhood of four thousand (4000) gallons of the flavored syrup. The syrup is delivered, as discussed above, through the piping 40, 42 into a mixing unit 50, where it is combined with carbonated water (not shown) prior to bottling.

In the conventional plant, when the syrup tank is empty, the piping 40, 42 is flushed and cleaned before a flavor change. The syrup present in the pipe is simply thrown away. The operation of the present invention, as hereinafter described, provides a way to utilize this previously discarded material.

Connected to the portion of pipe 42 are three feeds 60, 62, 64. The first feed 60 provides an inlet for pressurized $CO_2$ gas. The second feed 62 allows for the introduction of ambient air into the pipe 42. The third feed 64 allows for the inlet of water into the pipe 42. The second and third of these inlet feeds 62, 64 are currently present in most bottling operations to provide for cleaning and flushing out the existing piping 42.

In the embodiment of the present invention described herein, there are two probes 70 and 80 placed in connection with the piping 40, 42. These probes are one of a number of well known types that can differentiate between liquid or gas flowing within the pipe, and a detailed description is not deemed necessary. For example, the air trap filters described in the Du patent, discussed above, could serve as appropriate sensors. The first probe 70 is located between the dispensing tank 20 and the pump 30. When the last of the syrup is pumped out of the dispensing tank 20, the probe 70 senses the presence of air in the first pipe section 40. The probe 70 is in communication with the microprocessor 100, which sends a signal to cut off the pump 30 and open the inlet feed 60, which allows for the introduction of pressurized $CO_2$ gas into the pipe portion 42. The mixing operation thus continues in the mixing chamber 50. When the $CO_2$ has driven the syrup from most of the pipe section 42 into the mixing chamber 50, the probe 80 senses the presence of gas within the pipe section 42 and signals the microprocessor 100 to stop the mixing process. At this point, the piping 40, 42 can be flushed and cleaned normally, in anticipation of a flavor change.

The following is a list of the elements described in the above specification:

mixing operation 10
dispensing tank 20
pump 30
first pipe section 40
second pipe section 42
mixing unit 50
$CO_2$ feed 60
ambient air feed 62
water feed 64
first probe 70
second probe 80
microprocessor 100

It is to be understood that the present invention is not limited to the sole embodiment described above, but encompasses any and all embodiments within the scope of the following claims.

I claim:

1. An improvement in beverage bottling mixing apparatus utilizing flavored syrups comprising:

a dispensing tank for the holding of a quantity of flavored syrups;

a mixing chamber for the mixing of predetermined ratios of the syrups and carbonated water;

piping means extending from said dispensing tank to said mixing chamber;

a pump located on said piping means such that the activated pump describes a downstream and upstream flow in said piping means, and further defines a first portion of pipe disposed between said dispensing tank and said pump and a second portion of pipe disposed between said pump and said mixing chamber;

gas inlet means disposed on said second portion of said piping means for controlling the flow of gas thereto, said gas inlet means having an open and closed position;

processing means for control of said pump, said gas inlet means, and said mixing chamber;

a first sensor means located on said first portion of pipe, said sensor being in connection to said processing means such that when said first sensor detects an absence of syrup in said first portion of said piping means, said processing means deactivates said pump and opens said gas inlet means into said second portion of said piping means, thus impelling any syrup remaining in said second portion of said piping means downstream towards said mixing chamber;

a second sensor means located in said second portion of said piping means, said second sensor being in connection with said processing means such that when said second sensor detects an absence of syrup in said second portion of said piping means, said processing means deactivates the beverage mixing process.

2. The improvement according to claim 1, wherein said second portion of said piping means is at least 100 feet long.

3. The improvement according to claim 1, wherein said gas inlet means comprises a relay controlled valve that allows entry of a pressurized gas into said second portion of said piping means.

4. The improvement according to claim 3 wherein the gas introduced is Carbon Dioxide.

5. The improvement according to claim 1, wherein said second sensor means is located proximate to and upstream from said mixing chamber, such that a maximum amount of syrup is utilized before said second sensor means notifies said processing means to stop the mixing operation.

6. A method for preventing waste in a bottling operation utilizing flavored syrups comprising the steps of:

providing a dispensing tank, a syrup flow line, and a mixing chamber for the mixing of predetermined ratios of the syrup with carbonated water;

providing a pump to impel the syrup within the syrup flow line from said dispensing tank towards said mixing chamber where said pump defines a first section and a second section of said syrup flow line;

providing a pressurized gas inlet port within said second section of said syrup flow line;

providing processing means for controlling said pump, said mixing chamber, and said pressurized gas inlet port;

sensing air in said first section of said syrup flow line, indicating that the syrup supply in said dispensing tank has been depleted;

signalling said processing means of the lack of syrup in said first section of said flow line;

deactivating said pump by said processing means;

opening said pressurized gas inlet port in said second section of said flow line to allow the gas thus admitted to urge any remaining syrup towards said mixing chamber;

sensing gas in said second section of said flow line, said sensing step being performed proximate to and upstream from said mixing chamber;

signalling said processing means of the gas sensed in said second section of said flow line;

deactivating said mixing chamber, thus stopping the mixing and bottling process.

* * * * *